United States Patent [19]

Le Coent et al.

[11] 4,251,379

[45] Feb. 17, 1981

[54] DETERGENT-DISPERSANTS OF HIGH ALKALINITY FOR LUBRICATING OILS AND PROCESS FOR THEIR PREPARATION

[75] Inventors: Jean-Louis Le Coent, Le Havre; Bernard Demoures, Puteaux, both of France

[73] Assignee: Orogil, Courbevoie, France

[21] Appl. No.: 6,866

[22] Filed: Jan. 26, 1979

[30] Foreign Application Priority Data

Feb. 8, 1978 [FR] France ..... 78 03464

[51] Int. Cl.[3] ..... C10M 1/20; C10M 1/40

[52] U.S. Cl. ..... 252/33

[58] Field of Search ..... 252/33

[56] References Cited

U.S. PATENT DOCUMENTS 3,424,679 1/1969 Allphin ..... 252/33

FOREIGN PATENT DOCUMENTS 1080531 12/1954 France .

1015769 1/1966 United Kingdom .

*Primary Examiner*—W. J. Shine

[57] ABSTRACT

New detergent-dispersants of high alkalinity useful as additives for lubricating oils and a novel process for their preparation are provided.

The novel detergent-dispersant additives are prepared by:

(1) sulfurizing an alkylphenol in the presence of an alkylbenzene sulfonate of low or zero T.B.N., an alkaline earth base and an alkylene glycol;

(2) precarbonating the mixture thus obtained;

(3) super-alkalinizing and carbonating the resultant precarbonated mixture by means of an alkaline earth base, $CO_2$, and an alkylene glycol; and (4) eliminating the excess alkylene glycol.

These detergent-dispersant additives improve the detergent-dispersant power of lubricating oils.

26 Claims, No Drawings

DETERGENT-DISPERSANTS OF HIGH ALKALINITY FOR LUBRICATING OILS AND PROCESS FOR THEIR PREPARATION

BACKGROUND OF THE INVENTION

The present invention is directed to new detergent-dispersants of high alkalinity useful as additives for lubricating oils and to a novel process for their preparation.

British Pat. No. 1,015,769 discloses the preparation of detergent-dispersants of high alkalinity by:

(1) sulfurization of a mixture containing an alkylphenol and a metallic alkylbenzene sulfonate, in a molar ratio of sulfonate to alkylphenol of between 0.01 and 1:1, and preferably between 0.01 and 0.05:1, of a $C_8$–$C_{18}$ monoalcohol, an alkaline earth metal oxide or hydroxide and glycol;

(2) precarbonation of the sulfurized mixture;

(3) addition of an alkaline-earth metal oxide or hydroxide;

(4) carbonation of the resultant mixture; and (5) thereupon elimination of the glycol and recovery of the resultant detergent-dispersant.

It has been found that while such a process made it possible satisfactorily to prepare detergent-dispersants containing high percentages by weight of alkaline-earth metal alkylphenates, it did not make it possible to prepare detergent-dispersants containing high percentages by weight of alkaline-earth metal alkylbenzene sulfonates. As a matter of fact, if a large amount of initial alkylbenzene sulfonate compared with the amount of alkylphenol was used, the mixture to be sulfurized and carbonated would have such a viscosity that any sulfurization and carbonation operation would be impossible. It would have been perhaps possible to solve this problem by adding large amounts of a $C_8$–$C_{18}$ monoalcohol, which would then have presented serious drawbacks from an industrial standpoint with respect to the recycling of this monoalcohol in practically anhydrous form.

By the present invention, a new process has been provided which does not have the drawbacks of the prior art and which makes it possible to prepare novel detergent-dispersants having a base of alkylbenzene sulfonates and metal alkylphenates of a T.B.N. (Total Basic Number—A.S.T.M. Standard 2896) of more than 250.

It is, therefore, an object of the present invention to provide novel detergent-dispersants useful as additives for lubricating oils having a base of alkylbenzene sulfonates and metal alkylphenates.

It is also an object of the present invention to provide a novel process for the preparation of detergent-dispersants for use in lubricating oils.

It is also an object of the present invention to provide lubricating oils containing the novel additives of the invention.

Other objects of the present invention will be apparent to those skilled in the art from the present description.

GENERAL DESCRIPTION OF THE INVENTION

The novel process of preparing the novel detergent-dispersants of the invention employs alkaline-earth metal alkylbenzene sulfonates, alkylene glycol, sulfur and carbon dioxide in the following manner:

(1) reacting sulfur, at a temperature of between about 100° and 190° C., with an alkylphenol bearing one or more $C_6$–$C_{60}$ alkyl substituents in the presence of a dilution oil, an alkaline-earth metal alkylbenzene sulfonate of a molecular weight of more than about 300 and a T.B.N. less than or equal to about 170, a base derived from an alkaline-earth metal, and an alkylene glycol, the amount of alkylphenol used being between about 5 and 35 parts by weight per 100 parts by weight of total alkylphenol/alkylbenzene sulfonate mixture and the amount of alkylbenzene sulfonate being between 95 parts and 65 parts by weight per 100 parts by weight of alkylphenol/alkylbenzene sulfonate mixture;

(2) precarbonating the resultant mixture at a temperature of between about 100° and 250° C., by means of carbon dioxide;

(3) superalkalinizing and carbonating the resultant precarbonated mixture by means of a base selected from among alkaline earth metal oxides and hydroxides and carbon dioxide in the presence of an alkylene glycol at a temperature of between about 100° and 250° C.; and (4) eliminating the excess alkylene glycol and recovering the resultant detergent-dispersant of high alkalinity.

In the use of the term "alkylbenzene sulfonate," it is intended to refer to any solution containing from about 40 to 90 percent by weight, and preferably 55 to 80 percent by weight, of an alkylbenzene sulfonate in a dilution oil which may or may not be the same as the oil used to carry out the process of the invention.

In a preferred method:

(1) the sulfurization stage is carried out starting with an alkylbenzene sulfonate of a T.B.N. less than or equal to about 50 at a temperature of between about 120° and 180° C., and a pressure less than or equal to atmospheric pressure. This step can possibly be followed by a dehydration step at a higher temperature of between about 130° and 185° C., and preferably between about 150° and 185° C., at a pressure less than or equal to atmospheric pressure;

(2) the precarbonation step is carried out at atmospheric pressure, at a temperature of between about 160° and 185° C.;

(3) the superalkalinization-carbonation step is carried out at least once at a temperature of between about 120° and 180° C., at a pressure equal to or less than atmospheric pressure.

The amounts of reagents which can be used to carry out the process of the invention are as follows:

A. for the sulfurization step:

(1) preferably about 10 to 30 parts of alkylphenol to 100 parts of alkylphenol/alkylbenzene sulfonate mixture;

(2) preferably about 70 to 90 parts of alkylbenzene sulfonate to 100 parts of alkylphenol/alkylbenzene sulfonate mixture;

(3) from about 1 to 8 parts and preferably about 2 to 5 parts of sulfur to 100 parts of alkylphenol/alkylbenzene sulfonate mixture;

(4) from about 7 to 20 parts and preferably about 10 to 15 parts of alkaline-earth base to 100 parts of alkylphenol/alkylbenzene sulfonate mixture;

(5) from about 7 to 20 parts, and preferably about 7 to 17 parts, of alkylene glycol to 100 parts of alkylphenol/alkylbenzene sulfonate mixture.

B. for the carbonation step:

(1) the amount of $CO_2$ corresponds, within about 30 percent by weight, of the amount which can be completely absorbed by the sulfurized mixture; this amount of $CO_2$ preferably corresponds substantially to the amount which can be completely absorbed.

C. for the superalkalinization-carbonation step:

(1) from about 5 to 15 parts, and preferably about 8 to 12 parts, of alkaline-earth base to 100 parts of precarbonated mixture;

(2) from about 5 to 50 parts, and preferably about 20 to 40 parts, of alkylene glycol to 100 parts of precarbonated mixture;

(3) the amount of $CO_2$ may vary between the amount which can be completely absorbed and an excess of 40 percent by weight of said quantity; the amount of $CO_2$ will preferably correspond substantially to that which can be absorbed.

The superalkalinization-carbonation step is preferably carried out in two stages.

Among the alkylphenols which may be employed in the process of the invention are preferably those bearing one or more $C_9$–$C_{15}$ alkyl substituents and, in particular, the nonyl, decyl, dodecyl, and tetradecyl phenols.

Among the alkylbenzene sulfonates which may be employed are the sulfonic acid salts obtained by sulfonation of alkylbenzenes derived from $C_{15}$–$C_{30}$ olefins or olefin polymers and alkaline-earth metals such as calcium, barium, magnesium, etc.

Among the alkaline-earth bases which may be employed are calcium, barium, and magnesium oxides or hydroxides, etc.; the alkaline-earth metal from which the alkaline-earth base is derived may or may not be the same as that from which the alkaline-earth alkylbenzene sulfonate used is derived.

Among the dilution oils which may be employed are preferably the paraffin oils, such as 100 Neutral oil, etc., the naphthene oils, or mixed oils can also be employed. The amount of dilution oil which can be used is such that the amount of oil contained in the final product (including that coming from the initial alkylbenzene sulfonate) represents from about 20 to 60 percent by weight of said product and preferably from about 25 to 55 percent, and particularly from about 30 to 40 percent by weight of said product.

Among the alkylene glycols which may be employed and which is particularly satisfactory is ethylene glycol. One may possibly add to the sulfurization step up to 15 parts by weight per 100 parts by weight of alkylphenol-/alkylbenzene sulfonate mixture, a monoalcohol such as ethylhexanol, tridecylalcohol, the $C_8$–$C_{14}$ oxoalcohols, and in general, an alcohol having a boiling point of more than about 120° C., and preferably more than about 150° C.

One of the advantages of the process of the invention is that the presence of a monoalcohol in the sulfurization step is not indispensable.

One of the characteristics of the process of the invention is that the addition of alkylene glycol to both the sulfurization step and the superalkalinization-carbonation step is essential.

Another feature of the said process is that the weight of alkylphenol used, referred to the weight of detergent-dispersant solution obtained, is between about 8 and 18 percent.

The detergent-dispersants of high alkalinity obtained by the process of the invention constitute an important object of the invention. They can be added to lubricating oils in quantities which are a function of the T.B.N. of the said detergent-dispersants and a function of the future use of said oils. Thus, for a gasoline motor oil, the amount of detergent-dispersant of T.B.N. 300, for instance, to be added is generally between about 1 and 2.5 percent; for a diesel motor oil, it is generally between about 1.8 and 4 percent; for a marine motor oil, it may range up to about 25 percent.

The lubricating oils which can thus be improved can be selected from among a very large number of lubricating oils, such as the lubricating oils of naphthene base, paraffin base, and mixed base, other hydrocarbon lubricants, for instance, lubricating oils derived from coal products, and synthetic oils, for instance, alkylene polymers, polymers of the alkylene oxide type and their derivatives, including alkylene oxide polymers prepared by polymerizing alkylene oxide in the presence of water or alcohols, for example, ethyl alcohol, dicarboxylic acid esters, liquid esters of liquid acids of phosphorus acids, alkylbenzenes and dialkylbenzenes, polyphenols, alkyl biphenyl ethers, and polymers of silicon.

Additional additives can also be present in said lubricating oils in addition to the detergent-dispersants obtained by the present invention. Mention may be made, for instance, of antioxidant additives, anticorrosion additives, ash-less dispersant additives, etc.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLES 1 to 3

There is described below the general method of preparation (five stages) of the superalkalinized detergent-dispersants forming the object of Examples 1 to 3 and, in Tables 1 and 1A below, the quantities of reagents necessary for their preparation in each instance.

First Stage (sulfurization)

Into a 4-liter, four neck reactor provided with an agitator system and a heating device there are introduced dodecylphenol (DDP), 100 N oil, an approximately 60 percent solution in 100 N dilution oil of a calcium alkylbenzene sulfonate (abbreviated Ca sulfonate) of a molecular weight of about 470 (weight of the sodium salt), the solution containing 2.7 percent calcium and having a T.B.N. of about 25, and a methylpolysiloxane antifoam agent, marketed by Rhone-Poulenc under the designation "SI 200."

Lime and sulfur are then introduced into the reaction mixture with agitation; the mixture is brought to a temperature of 145° C. under 260 mm. of mercury pressure, whereupon the glycol is added during a period of one hour. Heating is effected at 165° C. and this temperature is maintained for one hour under 260 mm. of mercury in order completely to eliminate the water of reaction coming from the neutralization of the lime.

The water eliminated always carries a small amount of glycol with it.

Second Stage (precarbonation)

After having released the vacuum and heating the above reaction mixture to a temperature of 180° C., a precarbonation operation is carried out at 180° C. by means of carbon dioxide at atmospheric pressure until the end of the absorption of $CO_2$ (this phase lasts about two hours). Water is eliminated, entraining, as stated above, a small amount of glycol.

The precarbonated mixture thus obtained is analyzed; the result of this analysis is given in Table 1, below.

Third Stage (superalkalinization-carbonation)

The precarbonated mixture produced above is placed under a pressure of 260 mm. of mercury, and a mixture of lime and glycol is introduced.

The reaction mixture is dehydrated for 10 minutes at 145° C. by means of carbon dioxide for 25 minutes under 260 mm. of mercury and then for 35 minutes under atmospheric pressure.

Fourth Stage (superalkalinization-carbonation)

The operation of the third stage is repeated.

Fifth Stage (separation)

The superalkalinized carbonated mixture is brought to a temperature of 184° C. under 300 mm. of mercury pressure. The glycol distills over, filtration is effected to remove the sediment, and there is recovered a solution of 100 N oil of superalkalinized detergent-dispersant having the characteristics set forth in Table 1A, below.

TABLE 1

| Examples | 1 | 2 | 3 |
|---|---|---|---|
| First Stage: | | | |
| DDP in grams | 339 | 254 | 169.5 |
| Ca sulfonate in grams | 929 | 1073 | 1216.5 |
| DDP/sulfonate by weight | 27/73 | 19/81 | 12/88 |
| Oil in Grams | 253 | 190 | 126.5 |
| Lime in grams | 191 | 176.5 | 172.5 |
| Sulfur in grams | 59.5 | 44.5 | 29.5 |
| SI 200 in $cm^3$ | 0.4 | 0.4 | 0.4 |
| Ethylene glycol in grams | 206 | 196 | 192 |
| Second Stage: | | | |
| $CO_2$ in grams | 85 | 94 | 95.5 |
| Weight of precarbonated mixture (including oil + residual glycol) | 1894 | 1875 | 1860 |
| Analysis | | | |
| % Ca | 5.4 | 5.1 | 5.0 |
| % glycol in the medium | 5.96 | 5.76 | 5.70 |
| % sediment | 0.4 | 0.6 | 0.8 |
| Weight of distillate recovered (Water + glycol) | 113 | 108 | 106 |
| Third Stage: | | | |
| Lime in grams | 92 | 98.5 | 99 |
| Ethylene glycol in grams | 320 | 341 | 345 |
| $CO_2$ in grams | 50 | 51.5 | 56.5 |

TABLE 1A

| Examples | 1 | 2 | 3 |
|---|---|---|---|
| Fourth Stage: | | | |
| Lime in grams | 92 | 98.5 | 99 |
| Ethylene glycol in grams | 320 | 341 | 345 |
| $CO_2$ in grams | 50 | 51.5 | 56.5 |
| Weight of distillate collected in the Third and Fourth Stages | 360 | 375 | 375 |
| Fifth Stage: | | | |
| Glycol distilled in grams | 381 | 396 | 400 |
| % sediment | 0.8 | 1 | 2 |
| Weight of detergent-dispersant solution | 2020 | 2020 | 1997 |
| Analysis of the solution: | | | |
| % Ca | 10.7 | 11.0 | 10.8 |
| T.B.N. | 269 | 272 | 270 |
| Appearance | bright | bright | slightly cloudy |
| Compatability at 10% in a mineral oil (appearance of the solution) | clear | clear | slightly cloudy |
| Weight of DDP/weight of detergent-dispersant solution in % | 16.7 | 12.5 | 8.5 |

EXAMPLES 4 to 6

The operations described above for Examples 1 to 3 are carried out under the same conditions, starting with a 60 percent solution in 100 N oil of calcium alkylbenzene sulfonate of a molecular weight of about 470, said solution containing 3.4 percent calcium and having a T.B.N. of about 45.

The amounts of reagents used are set forth in Tables II and IIA, below. The characteristics of the product obtained are set forth in Table IIA, below.

TABLE II

| Examples | 4 | 5 | 6 |
|---|---|---|---|
| First stage: | | | |
| DDP in grams | 339 | 254 | 169.5 |
| Ca sulfonate in grams | 929 | 1073 | 1216.5 |
| DDP/sulfonate by weight | 27/73 | 19/81 | 12/88 |
| Oil in grams | 253 | 190 | 126.5 |
| Lime in grams | 179 | 162.5 | 156.5 |
| Sulfur in grams | 59.5 | 44.5 | 29.5 |
| SI 200 in $cm^3$ | 0.4 | 0.4 | 0.4 |
| Ethylene glycol in grams | 194 | 182 | 178 |
| Second Stage: | | | |
| $CO_2$ in grams | 79 | 87 | 87.5 |
| Weight of precarbonated mixture | 1890 | 1869 | 1852 |
| Anaylsis: | | | |
| % Ca | 5.5 | 5.2 | 5.1 |
| % Glycol | 5.9 | 5.8 | 5.9 |
| % Sediment | 0.4 | 0.6 | 0.8 |
| Weight of distillate | 109 | 102 | 98 |
| Third Stage: | | | |
| Lime in grams | 92 | 98.5 | 99 |
| Ethylene glycol in grams | 320 | 341 | 345 |
| $CO_2$ in grams | 50 | 51.5 | 56.5 |

TABLE IIA

| Examples | 4 | 5 | 6 |
|---|---|---|---|
| Fourth Stage: | | | |
| Lime in grams | 92 | 98.5 | 99 |
| Ethylene glycol in grams | 320 | 341 | 345 |
| $CO_2$ in grams | 50 | 51.5 | 56.5 |
| Weight of distillate collected in the Third and Fourth Stages in grams | 360 | 375 | 375 |
| Fifth Stage: | | | |
| Glycol distilled in grams | 381 | 396 | 400 |

TABLE IIA-continued

| Examples | 4 | 5 | 6 |
|---|---|---|---|
| % sediment | 0.8 | 1 | 2 |
| Weight of detergent-dispersant solution | 2016 | 2014 | 1989 |
| Analysis of the solution: | | | |
| % Ca | 10.8 | 11.0 | 10.8 |
| T.B.N. | 269 | 272 | 270 |
| Appearance | bright | bright | slightly cloudy |
| Compatibility at 10% in a mineral oil (appearance of the solution) | clear | clear | slightly cloudy |
| Weight of DDP/weight of detergent-dispersant solution in % | 16.8 | 12.6 | 8.5 |

EXAMPLES 7 to 9

The operations described above in Examples 1 to 3 are carried out under the same conditions, starting with a 60 percent solution of 100 N oil of a calcium alkylbenzene sulfonate of a molecular weight of about 470, said solution containing 1.8 percent of calcium and having a T.B.N. of zero.

The amounts of reagents used are set forth in Tables III and IIIA, below. The characteristics of the products obtained appear in Table IIIA, below.

TABLE III

| Examples | 7 | 8 | 9 |
|---|---|---|---|
| First Stage: | | | |
| DDP in grams | 339 | 254 | 169.5 |
| Ca sulfonate in grams | 929 | 1073 | 1216.5 |
| DDP/sulfonate by weight | 27/73 | 19/81 | 12/88 |
| Oil in grams | 253 | 140 | 126.5 |
| Lime in grams | 206 | 195 | 192.5 |
| Sulfur in grams | 59.5 | 44.5 | 29.5 |
| SI 200 in $cm^3$ | 0.4 | 0.4 | 0.4 |
| Ethylene glycol in grams | 221 | 214.5 | 212 |
| Second Stage: | | | |
| $CO_2$ in grams | 92.5 | 113.2 | 105.5 |
| Weight of precarbonated mixture | 1924 | 1911 | 1900 |
| Analysis | | | |
| % Ca | 5.3 | 5 | 4.9 |
| % Glycol | 6 | 5.7 | 5.7 |
| % Sediment | 0.4 | 0.6 | 0.8 |
| Weight of distillate | 115 | 112 | 110 |
| Third Stage: | | | |
| Lime in grams | 92 | 98.5 | 99 |
| Ethylene glycol in grams | 320 | 341 | 345 |
| $CO_2$ in grams | 50 | 51.5 | 56.5 |

TABLE IIIA

| Examples | 7 | 8 | 9 |
|---|---|---|---|
| Fourth Stage: | | | |
| Lime in grams | 92 | 98.5 | 99 |
| Ethylene glycol in grams | 320 | 341 | 345 |
| $CO_2$ in grams | 50 | 51.5 | 56.5 |
| Weight of distillate collected in Third and Fourth Stages | 360 | 375 | 375 |
| Fifth Stage: | | | |
| Glycol distillate in grams | 381 | 396 | 400 |
| % Sediment | 0.8 | 1 | 2 |
| Weight of detergent-dispersant solution | 2016 | 2014 | 2002 |
| Analysis of the solution: | | | |
| % Ca | 10.7 | 11.0 | 10.8 |

TABLE IIIA-continued

| Examples | 7 | 8 | 9 |
|---|---|---|---|
| T.B.N. | 269 | 272 | 272 |
| Appearance | bright | bright | slightly cloudy |
| Compatibility at 10% in a mineral oil (appearance of the solution) | clear | clear | slightly cloudy |
| Weight of DDP/weight of detergent-dispersant solution in % | 16.8 | 12.6 | 8.5 |

EXAMPLES 10 to 12

The operations described above in Examples 1 to 3 are carried out under the same conditions, starting with an 80 percent solution in 100 N oil of a calcium alkylbenzene sulfonate of a molecular weight of about 470, said solution containing 3.37 percent of calcium and having a T.B.N. of 33.

The amounts of reagents used appear in Tables IV and IVA, below. The characteristics of the product obtained appear in Table IVA, below.

TABLE IV

| Examples | 10 | 11 | 12 |
|---|---|---|---|
| First Stage: | | | |
| DDP in grams | 339 | 254 | 169.5 |
| Ca sulfonate in grams | 743 | 858 | 973 |
| DDP/sulfonate by weight | 31/69 | 23/77 | 15/85 |
| Oil in grams | 389 | 355 | 319.5 |
| Lime in grams | 191 | 176.5 | 172.5 |
| Sulfur in grams | 59.5 | 44.5 | 29.5 |
| SI 200 in $cm^3$ | 0.4 | 0.4 | 0.4 |
| Ethylene glycol in grams | 206 | 196 | 192 |
| Second Stage: | | | |
| $CO_2$ in grams | 85 | 94 | 95.5 |
| Weight of precarbonated mixture | 1829 | 1805 | 1787 |
| Analysis | | | |
| % Ca | 5.5 | 5.2 | 5.1 |
| % Glycol | 5.9 | 5.7 | 5.7 |
| % Sediment | 0.4 | 0.6 | 0.8 |
| Weight of distillate | 106 | 106 | 107 |
| Third Stage: | | | |
| Lime in grams | 92 | 98.5 | 99 |
| Ethylene glycol in grams | 320 | 341 | 345 |
| $CO_2$ in grams | 50 | 51.5 | 56.5 |

TABLE IVA

| Examples | 10 | 11 | 12 |
|---|---|---|---|
| Fourth Stage: | | | |
| Lime in grams | 92 | 98.5 | 99 |
| Ethylene glycol in grams | 320 | 341 | 345 |
| $CO_2$ in grams | 50 | 51.5 | 56.5 |
| Weight of distillate collected in Third and Fourth Stages | 360 | 375 | 375 |
| Fifth Stage: | | | |
| Glycol distillate in grams | 381 | 396 | 400 |
| % Sediment | 0.8 | 1 | 2 |
| Weight of detergent-dispersant solution | 2018 | 2017 | 1995 |
| Analysis of the Solution: | | | |
| % Ca | 11 | 11.3 | 11.1 |
| T.B.N. | 273 | 278 | 277 |
| Appearance | bright | bright | slightly cloudy |
| Compatibility at 10% in a mineral oil (appearance of the solution) | clear | clear | slightly cloudy |

TABLE IVA-continued

| Examples | 10 | 11 | 12 |
|---|---|---|---|
| Weight of DDP/weight of detergent-dispersant solution in % | 16.8 | 12.6 | 8.5 |

EXAMPLE 13

The operation described above in Example 1 is carried out by replacing the calcium sulfonate solution by an approximately 60 percent solution in 100 N oil of a magnesium alkylbenzene sulfonate (abbreviated Mg sulfonate) of a molecular weight of about 470, said solution containing 1.5 percent of magnesium and having a T.B.N. of about 20, so as to obtain a detergent-dispersant containing calcium and magnesium.

The amounts of reagents used are set forth in Tables V and VA, below. The characteristics of the product appear in Table VA, below.

TABLE V

| Example | 13 |
|---|---|
| First Stage: | |
| DDP in grams | 339 |
| Mg sulfonate in grams | 929 |
| DDP/sulfonate by weight | 27/73 |
| Oil in grams | 253 |
| Lime in grams | 191 |
| Sulfur in grams | 59.4 |
| SI 200 in $cm^3$ | 0.4 |
| Ethylene glycol in grams | 206 |
| Second Stage: | |
| $CO_2$ in grams | 85 |
| Weight of precarbonated mixture | 1894 |
| Analysis | |
| % Ca | 5.4 |
| % Glycol | 5.9 |
| % Sediment | 0.4 |
| Weight of distillate | 113 |
| Third Stage: | |
| Lime in grams | 92 |
| Ethylene glycol in grams | 320 |
| $CO_2$ in grams | 50 |

TABLE VA

| Example | 13 |
|---|---|
| Fourth Stage: | |
| Lime in grams | 92 |
| Ethylene glycol in grams | 320 |
| $CO_2$ in grams | 50 |
| Weight of distillate collected in Third and Fourth Stages | 360 |
| Fifth Stage: | |
| Glycol distilled in grams | 381 |
| % Sediment | 1 |
| Weight of detergent-dispersant solution | 2020 |
| Analysis of the solution: | |
| % Ca | 9.5 |
| % Mg | 0.68 |
| T.B.N. | 267 |
| Appearance | bright |
| Compatibility at 10% in a mineral oil (appearance of the solution) | clear |
| Weight of DDP/weight of detergent-dispersant solution in % | 16.8 |

EXAMPLE 14

The operation described above in Example 4 is carried out, the sulfurization step being effected at 165° C., at atmospheric pressure, for one hour. The subsequent dehydration stage is then superfluous.

The characteristics of the product obtained are similar to those set forth above for the product of Example 4.

EXAMPLE 15

The operation described above in Example 1 is carried out, reducing:

(1) the amount of glycol used in the sulfurization step to 7.5 percent; and (2) the amount used in all of the superalkalinization-carbonation steps to 10 percent; and (3) by increasing the amount of $CO_2$ by 20 percent by weight in the superalkalinization-carbonation step.

The amounts of reagents and characteristics of the product obtained appear in Tables VI and VIA, below.

TABLE VI

| Example | 15 |
|---|---|
| First Stage: | |
| DDP in grams | 339 |
| Ca sulfonate in grams | 929 |
| DDP/sulfonate by weight | 27/73 |
| Oil in grams | 253 |
| Lime in grams | 191 |
| Sulfur in grams | 59.4 |
| SI 200 in $cm^3$ | 0.4 |
| Ethylene glycol in grams | 95 |
| Second Stage: | |
| $CO_2$ in grams | 85 |
| Weight of precarbonated mixture | 1870 |
| Analysis | |
| % Ca | 5.5 |
| % Glycol | 4.2 |
| % Sediment | 0.4 |
| Weight of distillate | 40 |
| Third Stage: | |
| Lime in grams | 92 |
| Ethylene glycol in grams | 94 |
| $CO_2$ in grams | 65 |

TABLE VIA

| Example | 15 |
|---|---|
| Fourth Stage: | |
| Lime in grams | 92 |
| Glycol in grams | 94 |
| $CO_2$ in grams | 65 |
| Weight of distillate collected in Third and Fourth Stages | 60 |
| Fifth Stage: | |
| Glycol distilled in grams | 232 |
| % Sediment | 1 |
| Weight of detergent-dispersant solution | 2000 |
| Analysis of the solution: | |
| % Ca | 10.6 |

TABLE VIA-continued

| Example | 15 |
|---|---|
| T.B.N. | 268 |
| Appearance | bright |
| Compatibility at 10% in a mineral oil (appearance of the solution) | clear |
| Weight of DDP/weight of detergent-dispersant in % | 16.95 |

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A process of preparing a detergent-dispersant from an alkaline-earth metal alkylbenzene sulfonate, an alkylphenol, an alkaline-earth base, an alkylene glycol, sulfur, and carbon dioxide, which process comprises:

(1) reacting sulfur at a temperature between about 100° and 190° C., with an alkylphenol bearing one or more $C_6$–$C_{60}$ alkyl substituents, in the presence of a dilution oil, an alkaline-earth metal alkylbenzene sulfonate of a molecular weight of more than about 300, and a T.B.N. less than or equal to 170, a base derived from an alkaline-earth metal, and an alkylene glycol, the amount of alkylphenol used being between about 5 and 35 parts by weight per 100 parts by weight of alkylphenol/alkylbenzene sulfonate mixture, and the amount of alkylbenzene sulfonate being between 95 and 65 parts by weight to 100 parts by weight of alkylphenol/alkylbenzene sulfonate mixture;

(2) precarbonating the resultant mixture at a temperature of between about 100° and 250° C., with carbon dioxide;

(3) superalkalinizing and carbonating the resultant precarbonated mixture by means of a base selected from among the alkaline-earth metal oxides and hydroxides and of carbon dioxide in the presence of an alkylene glycol at a temperature of between about 100° and 250° C.; and (4) eliminating the excess alkylene glycol and recovering the resultant detergent-dispersant of high alkalinity.

2. A process according to claim 1, wherein the sulfurization step (1) is carried out in the presence of:

about 10 to 30 parts of alkylphenol to 100 parts of alkylphenol/alkylbenzene sulfonate mixture;

about 90 to 70 parts of alkylbenzene sulfonate to 100 parts of alkylphenol/alkylbenzene sulfonate mixture.

3. A process according to claim 1 or claim 2, wherein:

the sulfurization step (1) is carried out at a temperature of between about 120° and 180° C., at a pressure equal to or less than atmospheric pressure;

the precarbonation step (2) is carried out at a temperature between about 160° and 185° C., at atmospheric pressure;

the superalkalinization-carbonation step (3) is carried out at a temperature of between about 120° and 180° C., at a pressure equal to or less than atmospheric pressure.

4. A process according to any of claims 1 to 3, wherein the sulfurization step (1) is followed by a dehydration stage at a higher temperature of between about 130° and 185° C., at a pressure equal to or less than atmospheric pressure.

5. A process according to any of claims 1 to 3, wherein the superalkalinization-carbonation step (3) is carried out in at least one stage.

6. A process according to claim 5, wherein the superalkalinization-carbonation step (3) is carried out in two stages.

7. A process according to any of claims 1 to 4, wherein the sulfurization step (1) is carried out in the presence of:

about 1 to 8 parts of sulfur to 100 parts of alkylphenol/alkylbenzene sulfonate mixture;

about 7 to 20 parts of alkaline earth base to 100 parts of alkylphenol/alkylbenzene sulfonate mixture;

about 7 to 20 parts of alkylene glycol to 100 parts of alkylphenol/alkylbenzene sulfonate mixture.

8. A process according to claim 7, wherein the sulfurization step (1) is carried out in the presence of:

about 2 to 5 parts of sulfur to 100 parts of alkylphenol/alkylbenzene sulfonate mixture;

about 10 to 15 parts of alkaline earth base to 100 parts of alkylphenol/alkylbenzene sulfonate mixture;

about 7 to 17 parts of alkylene glycol to 100 parts of alkylphenol/alkylbenzene sulfonate mixture.

9. A process according to any of claims 1 to 3, wherein the precarbonation step (2) is carried out by means of an amount of $CO_2$ corresponding to within about 30 percent by weight to the amount which can be completely absorbed by the sulfurized mixture.

10. A process according to claim 9, wherein the precarbonation step (2) is carried out by means of an amount of $CO_2$ which can be completely absorbed by the sulfurized mixture.

11. A process according to any of claims 1, 2, 3, and 5, wherein the superalkalinization-carbonation step (3) is carried out in the presence of:

about 5 to 15 parts by weight of alkaline earth base to 100 parts of precarbonated mixture;

about 5 to 50 parts of alkylene glycol to 100 parts of precarbonated mixture;

an amount of $CO_2$ varying between the amount which can be completely absorbed and an excess of 40 percent by weight over said value.

12. A process according to claim 11, wherein the superalkalinization-carbonation step (3) is carried out in the presence of:

about 8 to 12 parts of alkaline earth base to 100 parts of precarbonated mixture;

about 20 to 40 parts of ethylene glycol to 100 parts of precarbonated mixture;

an amount of $CO_2$ corresponding to the amount which can be completely absorbed.

13. A process according to claims 1 or 3, wherein the amount of dilution oil is such that the amount of oil contained in the final detergent-dispersant product is between about 20 and 60 percent of said product.

14. A process according to claim 13, wherein the amount of oil is such that the amount of oil in the final product is between about 25 and 55 percent of the said product.

15. A process according to claims 1 or 2, wherein the weight of alkylphenol used referred to the weight of final detergent-dispersant product is between about 8 and 18 percent.

16. A process according to any of claims 1 to 4, 7, and 8, wherein the alkylphenol used contains at least one $C_9$–$C_{15}$ alkyl substituent.

17. A process according to claim 16, wherein the alkyl phenol is selected from among nonyl, decyl, dodecyl, and tetradecyl phenols.

18. A process according to any of claims 1 to 4, 7, and 8, wherein the alkaline earth metal alkylbenzene sulfonate has a T.B.N. less than or equal to 50.

19. A process according to any of claims 1 to 4, 7, 8, and 18, wherein the alkylbenzene sulfonate is a member selected from the calcium, barium, or magnesium salts of a sulfonic acid obtained by sulfonation of an alkylbenzene derived from a $C_{15}$–$C_{30}$ olefin or olefin polymer.

20. A process according to any of claims 1 to 8, 11, and 12, wherein the base derived from an alkaline earth metal is a member selected from calcium, barium, magnesium oxides and hydroxides.

21. A process according to claim 20, wherein the alkaline earth metal from which the base is derived is the same as that from which the alkylbenzene sulfonate is derived.

22. A process according to any of claims 1 to 8, 11, and 12, wherein the alkylene glycol is ethylene glycol.

23. A detergent-dispersant additive for lubricating oils, obtained by the process defined by any of claims 1 to 22.

24. A lubricating composition, having desirable detergent and dispersion properties, comprising an oil containing between about 1 and 25 percent by weight of a novel lubricant additive composition according to claim 23.

25. A gasoline engine oil, having desirable detergent and dispersion properties, containing between about 1 and 25 percent by weight of a novel lubricant additive composition according to claim 23.

26. A diesel engine oil having desirable detergent and dispersion properties containing between about 1.8 and 4 percent by weight of a novel lubricant additive composition according to claim 23.

* * * * *